United States Patent [19]

Eckart

[11] 4,357,025

[45] Nov. 2, 1982

[54] REGENERATOR SEAL DESIGN

[75] Inventor: Francis H. Eckart, Bargersville, Ind.

[73] Assignee: General Motors Corporation, Detroit, Mich.

[21] Appl. No.: 157,688

[22] Filed: Jun. 9, 1980

[51] Int. Cl.[3] ..... F16J 15/34; F28D 19/00

[52] U.S. Cl. ..... 277/26; 277/81 R; 165/9

[58] Field of Search ..... 277/81 R, 81 S, 81 P, 277/26, 12, 22; 165/9

[56] References Cited

U.S. PATENT DOCUMENTS

| | | | |
|---|---|---|---|
| 2,732,184 | 1/1956 | Ballard et al. | 165/9 |
| 3,360,275 | 12/1967 | McCreary | 165/9 X |
| 3,368,613 | 2/1968 | Addie et al. | 165/9 |
| 3,743,008 | 7/1973 | Zeek et al. | 165/9 |
| 3,761,101 | 9/1973 | Good et al. | 165/9 |
| 3,954,135 | 5/1976 | Hewlitt | 165/9 |
| 4,183,539 | 1/1980 | French et al. | 277/81 R X |

*Primary Examiner*—Robert S. Ward, Jr.
*Attorney, Agent, or Firm*—J. C. Evans

[57] ABSTRACT

A rotary regenerator disc matrix has a face seal with a cross arm and arcuate rim segments joined by prestress clamps to prestrain the arcuate rim seals so as to compensate seal rim twisting or coning and resultant disc face seal leakage as produced by operating thermal gradients across the seal.

5 Claims, 6 Drawing Figures

REGENERATOR SEAL DESIGN

The invention described herein was made in the performance of work under a NASA contract funded by the Department of Energy of the U.S. Government.

This invention relates to gas turbine engine power plants or other fuel burning apparatus with regenerators for recovering exhaust heat and more particularly to rotary regenerator mechanisms including rim seal segments in a disc face seal assembly maintained to desired degrees of flatness under conditions of operation wherein a substantial thermal gradient exists from an inside edge to the outside edge of the arcuate rim seal segments.

The use of rotating heat exchangers or regenerator discs for recovering exhaust heat in either gas turbine engine applications or other combustion engine applications with heat recovery are known and are operative to increase efficiency especially in vehicular gas turbine engines and the like. Such heat recovery is especially desirable in the case of automotive gas turbine engines since much of the operating mode of such vehicles is a light duty operation of the engine during which time only a fraction of the rated power of the gas turbine engine is required to drive the vehicle. In such arrangements, a rotary regenerator of the type having a matrix disc is more desirable than a fixed stationary recuperator form of heat recovery system since rotary regenerators offer a reduced size advantage and also have a reduced pressure drop for a given value of heat transfer effectiveness. However, in such arrangements, it is necessary to include regenerator matrix or disc rubbing seal assemblies to avoid excessive flow bypass between high pressure and low pressure regions in air and gas paths of the engine.

Typically, such structure includes a circular regenerator disc or matrix mounted within a cast engine block that encloses the operative components of the power plant. The power plant includes a rotary compressor which receives air from an engine intake to be compressed for combustion with a fuel supply. The compressor is operative to discharge the intake air at an increased total pressure into a suitable diffuser structure which conducts comparatively cool and high pressure air to an air intake chamber defined by a portion of the cast engine block. The diffuser reduces the the velocity pressure of the compressed intake air to produce an increase in static pressure of the intake air.

The regenerator matrix structure is located either above or to one side of the air intake chamber and the compressed intake air passes through a sector-like opening formed in the engine block on either side of the regenerator matrix disc and through a first portion of the regenerator matrix into a passage which communicates with a fuel combuster. The high pressure intake air that passes through the regenerator is confined to this first matrix portion. Also, the entire circumference of the regenerator is generally exposed to the aforesaid relatively cooler and high pressure compressor discharge air.

Following combustion, high temperature motive fluid gases are conducted to an annular gas passage within which a two-stage turbine wheel arrangement is disposed to be driven by motive fluid from the combustor. Typically, the turbine wheel associated with the first turbine stage is connected to the rotary compressor unit in driving relationship therewith and the turbine wheel associated with the second turbine stage is operatively connected to a power input member of speed reduction transmission which is coupled to power transfer components to form a complete compact automotive drive unit.

The high temperature combustion gas which is exhausted from the turbine stages is passed into an inboard exhaust chamber within the engine block. Typically, the inboard exhaust chamber is situated below a second portion of the rotary regenerator matrix or disc at a location displaced from the first regenerator matrix portion or sector. Second sector-like openings are formed in the engine housing or engine block housing on either side of the regenerator matrix disc and are adapted to accommodate the passage of hot combustion exhaust gases through the second matrix portion into an outboard exhaust chamber for flow through an exhaust opening in the engine.

The hot exhaust gases are effective to heat the second regenerator matrix portion to an elevated temperature and as the matrix disc is rotated the heated matrix disc passes relative to the inflowing relatively cooler, compressed intake air to effect a transfer of thermal energy from the hot to cooler gases. As the same matrix portion is again brought into contact with the heated exhaust gases a transfer of thermal energy again takes place from the exhaust gas to the matrix structure and the cycle is thus repeated continually during engine operation.

A hot side and cold side seal wear assemblies are located between the engine block and the hot and cold faces of the regenerator disc to prevent gas bypass between the high pressure and the low pressure sides of the matrix during the heat exchange process.

Typically, such arrangements include a flat wear face on a seal platform which is spring biased to place the flat wear face of the seal into sealing engagement with a portion of the rim of the matrix and along a cross segment of the matrix at a cross arm seal portion of the seal assembly thereby to define the separate flow sectors through the matrix.

Because of the continual temperature and pressure changes during engine operation the regenerator matrix disc tends to warp and/or the seal platform will tend to distort to alter an initial cold start flat sealing relationship between the wear face of the seal assemblies and the hot and cold faces of the rotating matrix disc. Accordingly, the biasing system for the seal must in part accommodate such changes in facing seal relationship between the wear face and disc to prevent an undesirable and wasteful bypassing or direct flow of high pressure cooler inlet air to the exhaust side of the matrix and vice-versa during the above-described regenerative heat recovery cycle. An example of such a spring biased seal assembly is set forth in U.S. Pat. No. 3,743,004, issued July 7, 1973, to Zeek et al, for REGENERATOR SEAL.

In addition to accommodating for thermal distortion in the matrix disc and the engine block, a further consideration is that each of the seal assemblies has a large thermal expansion gradient across the seal platforms that will tend to cause the seal platform at the high and low pressure rim portions thereof to twist or cone. One accommodation of this problem is to design the seal platform rim section with a sufficiently great thickness-to-width ratio to provide sufficient heat capacity and mechanical strength to prevent the twisting or cone effects.

Such seal assemblies are formed as multiple piece units that expand relative to one another in response to differences in operating temperatures without imposing a differential radial restraint at the rim portion of the seal platforms. Such arrangements, however, require special considerations to prevent leakage at the joint separation points.

Accordingly, an object of the present invention is to provide an improved rotary regenerator seal assembly including separate high and low pressure rim seal segments and a cross arm joined by rim restraint components that are configured to minimize rim twisting or coning as produced by thermal gradients across a platform of the high and low pressure rim seal members.

Another object of the present invention is to provide an improved regenerator seal assembly including a three member seal having a cross arm component and a high and low pressure rim component and wherein opposite ends of the cross arm are joined by restraint plates to opposite ends of the high and low rim seals so as to impose a bending moment on each of the rim seals to produce a controlled elastic elongation in the inside diameter edge regions of the rim seals exposed to the highest temperatures across the platforms of the rim seal components and a corresponding elastic compression in the outside diameter region of the rim seals and wherein both the elastic elongation and compression is selected to compensate for thermal expansion produced across the inside edge and the outside edge of the rim seal platforms because of operating thermal gradients produced thereacross during engine operation.

Yet another object of the present invention is to provide an improved regenerator seal assembly having generally semicircularly configured high pressure and low pressure rim seal segments and a cross arm component extending thereacross and wherein each of the rim seal segments has inner and outer edges subjected to high and low temperatures, respectively, during selected modes of engine operation; the temperature difference between the high and low temperatures producing a thermal gradient radially across the width of the platform of the high and low pressure rim seal segments of the seal assembly and wherein each of the rim seal segments includes a face seal and spring means for locating the face seal in a sliding sealing engagement with a face of a rotary matrix regenerator disc and wherein the thermal gradient across the seal platform will tend to produce twisting or coning of the platform during engine operation, the improvement being accomplished by provision of outwardly directed tabs on opposite ends of the generally semicircularly configured rim seal segments and the cross arm seal having a platform with end segments thereon extending in a somewhat radial direction from the center of the regenerator matrix disc; and wherein clamp means are provided to clamp sets of adjacent end tabs on the rim seal segments with respect to one end segment of the cross arm seal to elastically compress the outer edge of the rim segments and to elastically elongate the inner edges thereof sufficiently to compensate for twisting or coning of the rim segments during operation of the engine at higher temperature conditions with elevated thermal gradients produced across the platform portions of the rim seal segments and with the elastic elongation and elastic compression constituting a pre-stress condition in the seal assembly that will neutralize the effect of thermal gradients across the rim seal segments so as to maintain the face seal of the regenerator seal assembly in near flat relationship with the regenerator disc faces during engine operation.

Further objects and advantages of the present invention will be apparent from the following description, reference being had to the accompanying drawings wherein a preferred embodiment of the present invention is clearly shown.

Figure 1:
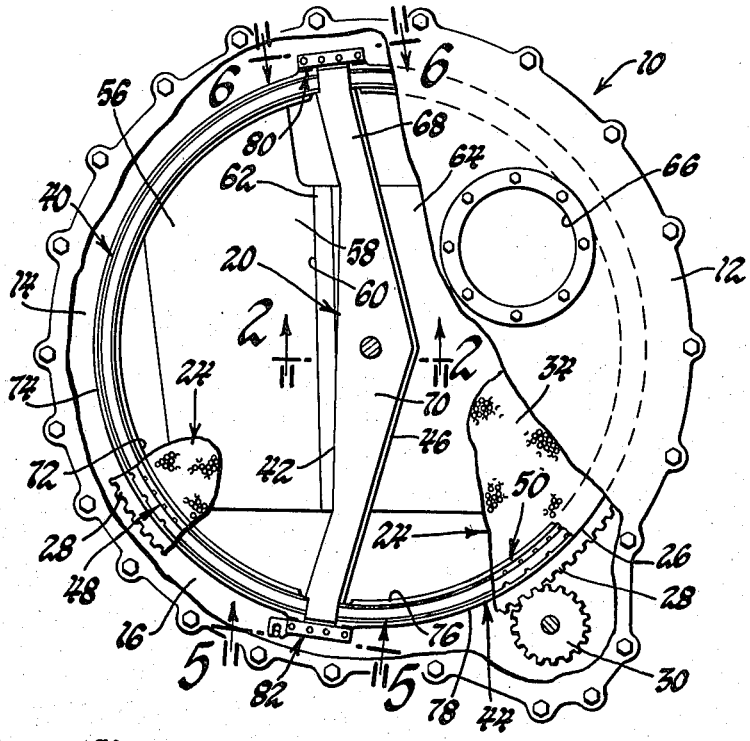
FIG. 1 is a fragmentary elevational view partially broken away and partially sectioned of a rotary regenerator and regenerator seal assembly constructed in accordance with the present invention.
Figure 3:
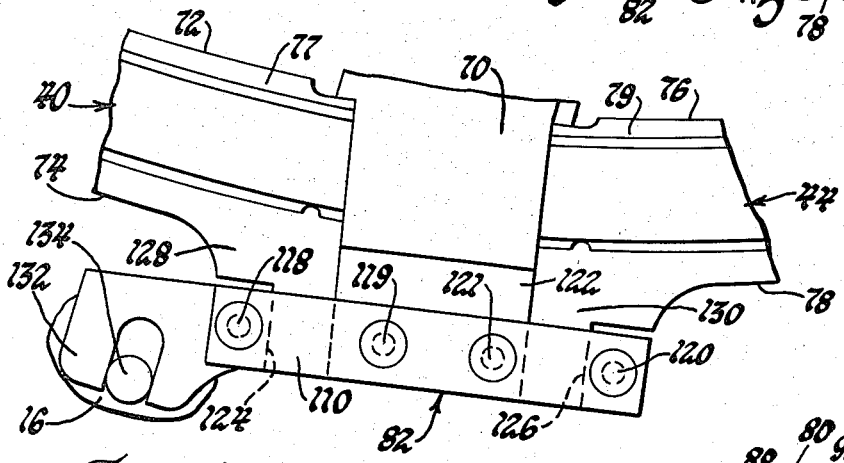
FIG. 3 is an enlarged, fragmentary bottom elevational view of a rim restraint clamp in accordance with the present invention.
Figure 4:
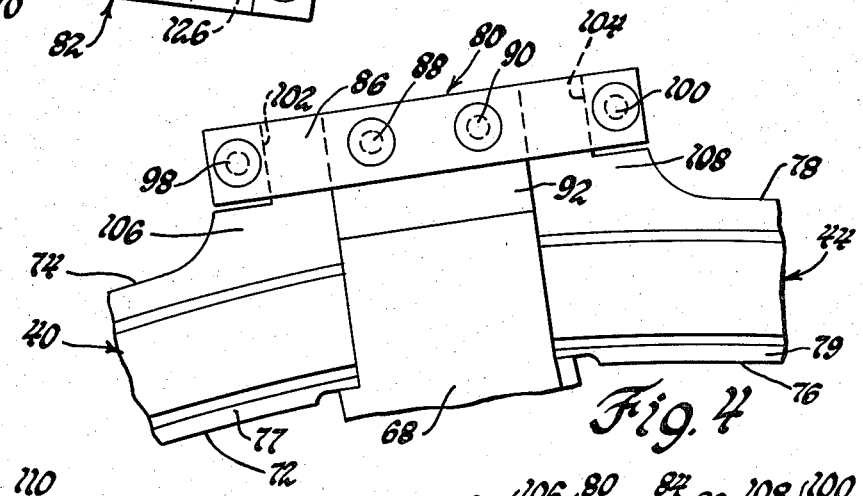
FIG. 4 is a fragmentary, enlarged elevational view of a cross arm and rim restraint clamp at the opposite end of the cross arm from the clamp of FIG. 3.
Figure 5:
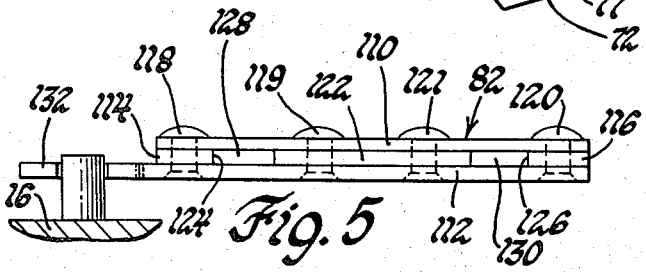
FIG. 5 is an enlarged end elevational view viewed from the line 5—5 in FIG. 1 looking in the direction of the arrows.
Figure 6:
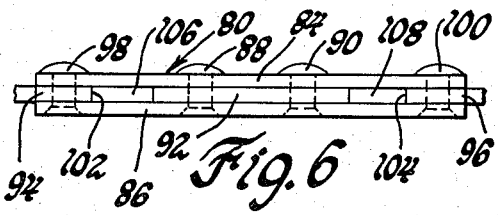
FIG. 6 is an enlarged end elevational view viewed from the line 6—6 in FIG. 1 looking in the direction of the arrows.

Referring now to FIG. 1, a rotary regenerator assembly 10 includes a cover 12 on one side of an engine block 14. The block 14 includes an annular, undercut planar surface 16 therein to define a seal assembly support. Furthermore, the block 14 includes an integral cross arm 18 having an inboard cross arm seal assembly 20 formed thereacross to engage the hot side surface 22 of a regenerator disc 24 in the form of a circular matrix having an outer rim 26 thereon secured to an annular drive ring 28 that is meshed with a drive pinion 30 from a cross-drive assembly of the type set forth more particularly in U.S. Pat. No. 4,157,013, issued June 5, 1979, to Bell for WATER COOLED GAS TURBINE ENGINE.

An outboard cross arm seal assembly 32 engages the cold matrix surface 34 of the disc 24. It includes a platform 36, leaf spring seal 37 and seal wear face 38 connected thereto and engaged with cover 12 and surface 34, respectively. Examples of such an arrangement are more specifically set forth in above U.S. Pat. No. 4,157,013. Furthermore, a hot side air bypass rim seal assembly 40 is located on surface 16 on one side 42 of the inboard cross arm seal assembly 20 and a gas side bypass rim seal assembly 44 is supported by the planar surface 16 on the opposite side 46 of the cross arm seal assembly 20. Cold face air and gas side bypass rim seal assemblies 48, 50 are shown partially in FIG. 1.

Figure 2:
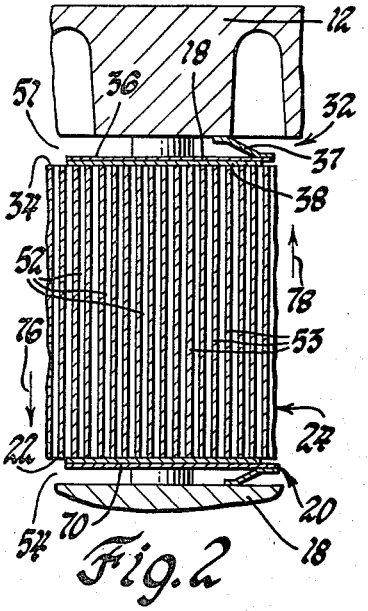
FIG. 2 is a fragmentary, enlarged sectional view taken along the line 2—2 of FIG. 1 looking in the direction of the arrows.

Thus, seal assemblies are provided between each of the hot and cold faces of the disc 24 and its housing as defined by cover 12 and block 14. Such seal assemblies are included to confine air and gas fluid flow paths through the matrix from an inlet space or opening 51 which receives compressed air from the outlet of a gas turbine engine compressor. The compressed air from the inlet opening 51 is directed through open ended pores or passages 52 in the disc 24. In one working embodiment, the matrix of disc 24 is fabricated from a metal or ceramic such as alumina silicate and has a cell wall thickness in the order of 0.008 cm, diagrammatically shown by the cell wall 53 of the fragmentary sectional view of FIG. 2.

The air flow from the opening 51 is heated as it flows through the rotating disc 24 and passes into a plenum 54 within the block 14 for a combustor can 56 where the compressed air is heated by combustion with fuel flow in the combustor can 56.

The combustor can 56 has an outlet transition 58 thereon connected to an inlet end 60 of a turbine nozzle 62 which supplies motive fluid to a gasifier turbine and a downstream power turbine as more specifically set forth in the aforesaid U.S. Bell Pat. No. 4,157,013.

Exhaust flow from the turbines enters through an exhaust passage 64 serving as a counterflow gas path to the hot side surface 22 of the matrix disc 24 on the opposite side of the cross arm seal assemblies 20, 32 from the inlet and plenum spaces 51, 54. The counterflow exhaust from passage 64 heats the matrix disc 24 as it passes through the passages 52 and thence is discharged through an exhaust opening 66 in the cover 12.

Each cross arm seal assembly 20, 32 includes two arms 68, 70 extending radially and somewhat diametrically of the matrix surfaces 22, 34 and joined together at the center of the matrix and joined at the outer rim of the matrix by the seal assemblies 40, 44, 48 and 50. Assemblies 40, 48 have an arcuate edge 72 thereon and associated components that extend around the high pressure inlet opening 51 and plenum space 54. The gas side bypass rim seal assemblies 44, 50 likewise include an arcuate inside edge 74 and associated parts that extend around the gas flow paths. The seal assembly components thus define an air path 76 therebetween for high pressure air flow and a gas path 78 therebetween for the low pressure exhaust gas flow from the gas turbine engines with these parts being best shown in FIGS. 1 and 2.

The cross arm seal arms 68, 70 extend between the high pressure and low pressure fluid paths 76, 78 and the seal assemblies 40, 44, 48, 50 seal and disc 24 adjacent to its outer periphery and to the block 14 and cover 12 for maintaining a pressure sealed relationship therebetween.

In accordance with the present invention, the illustrated inboard cross arm seal 20, the bypass rim seal 40 and the gas side bypass rim seal 44 constitute three separate parts that are improved by use of the present invention.

As previously discussed, the sealing efficiency and wear life of such regenerator disc base seals is dependent upon the degree of flatness that can be maintained in them at their seal face throughout the total range of engine operating conditions. Seal wear face flatness is difficult to maintain, in part, because of unavoidably large temperature gradients that create correspondingly large thermal expansion gradients between the inside diameter or arcuate edge 72 of the hot face air bypass rim seal 40 and the arcuate outside edge 74 thereof and a like arcuate inside edge 76 of the hot side air bypass rim seal 44 and its arcuate outside edge 78.

In accordance with the present invention, rim twisting or coning at the platforms 77, 79 of the rim seals 40, 44, respectively, is reduced by use of an improved rim prestrain system including a first rim restraint or pre-stress clamp 80 and a second rim restraint or pre-stress clamp 82.

The rim restraint clamp 80 includes a pair of spaced plates 84, 86 each fixedly secured by means of a pair of rivets 88, 90 to a first outboard end 92 on the platform portion of the arm 68 which is shown at the upper part of FIG. 1. The rim restraint clamp 80 further includes a pair of spacer segments 94, 96 that are fixedly secured to opposite ends of the plates 84, 86 by rivets 98, 100, respectively.

The resultant rim restraint clamp 80 includes accurately spaced rectangular openings 102, 104 having fixed dimensions that capture tabs 106, 108 formed on opposite ends of the platforms 77, 79 of rim seals 40, 44. The rim restraint clamp 80 thus constitutes a first reference point against which the rim seals 40, 44 can be prestressed for reasons to be discussed. To accomplish the pre-stress the rim restraint clamp 82 also defines a ground point to capture opposite tab ends on the platforms 77, 79 of rim seals 40, 44 so as to produce an elastic elongation in the region of the inside diameters 72, 76 and an elastic compression in the region of the arcuate outside edges 74, 78.

More particularly, the rim restraint clamp 82 includes a pair of clamp plates 110, 112 joined at opposite ends thereof to each other and to spacer members 114, 116 by means of rivets 118, 120. Likewise, rim restraint clamp 82 has the plates 110, 112 fixedly secured by rivets 119, 121 to an outboard end 122 formed on the platform arm 70. Thus, as in the case of the rim restraint clamp 80 the rim restraint clamp 82 includes two accurately located rectangular openings 124, 126 that supportingly receive outboard tabs 128, 130 on each of the opposite ends of the rim seals 40, 44. Tabs 128, 130 are somewhat diametrically located from the previously described tabs 106, 108. The location of the openings 124, 126 is such that the tabs 106, 128 on the seal 40 will cause its platform to be pre-stressed to compensate in part for the differential thermal expansion that is produced across the substrate in the inside edge 72 and the outside edge 74 thereof. Likewise, the tabs 106, 130 will be restrained with respect to one another to place a predetermined prestress in the platform of the gas bypass rim seal 44 to produce a second predetermined elastic compression and/or elastic elongation of the part so as to compensate for differential thermal expansions that occur across the rim seal 44 between its inside and outside edges 76, 78.

The bending moments imposed by the improved rim restraint clamps 80, 82 are selected to offset as much of the thermal gradients at all circumferential locations as is possible with it being recognized that any single preselected bending moment can compensate for only part of the thermal expansion produced by operating conditions. Nevertheless, the compensating prestress producing bending moments imposed by the improved rim restraint pre-stress clamps 80, 82 are able to essentially compensate the maximum thermal gradient effect of platform coning or twisting and thereby will maintain the wear faces of the bypass rim seals 40, 44 at substantially greater degrees of flatness.

In the illustrated arrangement, the rim restraint clamp 82 is free to adjust radially by provision of a slot end 132 that follows a fixed pin 134 in block 14. Pin 134 locates the total seal assembly against rotation with respect to the matrix during operation of the rotary regenerator assembly 10.

The pre-stress clamps are disclosed in the inboard seal components which are hotter running than like outboard components. If required, like clamps can be provided on such cooler running outboard seal components for sealing regenerator disc surface 34.

While the embodiments of the present invention, as herein disclosed, constitute preferred forms, it is to be understood that other forms might be adopted.

The embodiments of the invention in which an exclusive property or privilege is claimed are defined as follows:

1. In a regenerator seal assembly having rim segment with a platform including inner and outer edges thereon subjected to a thermal gradient radially thereacross and wherein the platform includes a face seal element thereon located in flat sealed relationship with a face of a rotary matrix regenerator disc and wherein the thermal gradient across the platform tends to cause it to twist as an inner hotter running edge of the platform is forced closer to the rotary matrix disc and a cooler operating edge is thereby moved outwardly of the disc face so as to move the seal element from a desired flat sealed relationship with the rotary sealed matrix, the improvement comprising: an outwardly directed tab on each opposite end of the rim segment platform, a cross arm seal having a platform thereon, means for clamping the end tabs of said rim segment with respect to said cross arm seal platform to elastically elongate the inner edge of the rim segment platform while elastically compressing the outside edge of the rim segment platform thereby to compensate for twisting or coning of the rim segment platform between the hot inner edge and the cooler outside edge thereof because of thermal gradients produced thereacross so as to tend to maintain the seal face in a flat sealed relationship with the rotating matrix disc.

2. In a regenerator seal assembly having rim segment with a platform including inner and outer edges thereon subjected to a thermal gradient radially thereacross and wherein the platform includes a face seal element thereon located in flat sealed relationship with a face of a rotary matrix regenerator disc and wherein the thermal gradient across the platform tends to cause it to twist as an inner hotter running edge of the platform is forced closer to the rotary matrix disc and a cooler operating edge is thereby moved outwardly of the disc face so as to move the seal element from a desired flat sealed relationship with the rotary sealed matrix, the improvement comprising: an outwardly directed tab on each opposite end of the rim segment platform, a cross arm seal having a platform thereon, means for clamping the end tabs of said rim segment with respect to said cross arm seal platform to elastically elongate the inner edge of the rim segment platform while elastically compressing the outside edge of the rim segment platform thereby to compensate for twisting or coning of the rim segment platform between the hot inner edge and the cooler outside edge thereof because of thermal gradients produced thereacross so as to tend to maintain the seal face in a flat sealed relationship with the rotating matrix disc, a support platform, and means for locating said joined rim segment and cross arm for free radial expansion with respect to said support platform for the joined rim and cross arm at one of the connection points therebetween so as to accommodate thermally induced expansion of the regenerator seal assembly with respect to the platform at elevated temperature conditions of operation.

3. In a regenerator seal assembly having a generally semicircularly configured rim segment with a platform including inner and outer edges thereon subjected to a thermal gradient radially thereacross and wherein the platform includes a face seal element thereon located in flat sealed relationship with a face of a rotary matrix regenerator disc and wherein the thermal gradient across the platform tends to cause it to twist as an inner hotter running edge of the platform is forced closer to the rotary matrix disc and a cooler operating edge is thereby moved outwardly of the disc face so as to move the seal element from a desired flat sealed relationship with the rotary sealed matrix, the improvement comprising: an outwardly directed tab on each opposite end of the generally semicircularly configured rim segment platform, a cross arm seal having a platform thereon, means for clamping the end tabs of said rim segment with respect to said cross arm seal platform to elastically elongate the inner edge of the rim segment platform while elastically compressing the outside edge of the rim segment platform thereby to compensate for twisting or coning of the rim segment platform between the hot inner edge and the cooler outside edge thereof because of thermal gradients produced thereacross so as to tend to maintain the seal face in a flat sealed relationship with the rotating matrix disc.

4. In a regenerator seal assembly having two generally semicircularly configured rim segments each with a platform including inner and outer edges thereon subjected to a thermal gradient radially thereacross and wherein the platform includes a face seal element thereon located in flat sealed relationship with a face of a rotary matrix regenerator disc and wherein the thermal gradient across each of the platforms tends to cause it to twist as an inner hotter running edge of the platform is forced closer to the rotary matrix disc and a cooler operating edge is thereby moved outwardly of the disc face so as to move the face seal element from a desired flat sealed relationship with the rotary sealed matrix, the improvement comprising: an outwardly directed tab on each opposite end of each of the generally semicircularly configured rim segments, a cross arm seal having a platform thereon with end segments thereon, first clamp means for clamping one end tab of each rim segment with respect to one end segment of said cross arm seal platform, second clamp means for clamping the other end tab of each rim segment to the other end segment of said cross arm seal platform to produce bending moments between said first and second clamp means to elastically elongate the inner edges of each of the rim segment platforms while elastically compressing the outside edge of each of the rim segment platforms thereby to compensate for twisting or coning of each of the rim segment platforms between the hot inner edge and the cooler outer edge thereof because of thermal gradients produced thereacross so as to tend to maintain the seal face in a flat sealed relationship with the rotating matrix disc.

5. In a regenerator seal assembly having two generally semicircularly configured rim segments each with a platform including inner and outer edges thereon subjected to a thermal gradient radially thereacross and wherein the platform includes a face seal element thereon located in flat sealed relationship with a face of a rotary matrix regenerator disc and wherein the thermal gradient across each of the platforms tends to cause it to twist as an inner hotter running edge of the platform is forced closer to the rotary matrix disc and a cooler operating edge is thereby moved outwardly of the disc face so as to move the face seal element from a desired flat sealed relationship with the rotary sealed matrix, the improvement comprising: an outwardly directed tab on each opposite end of each of the generally semicircularly configured rim segments, a cross arm seal having a platform thereon with end segments thereon, first clamp means for clamping one end tab of each rim segment with respect to one end segment of said cross arm seal platform, second clamp means for clamping the other end tab of each rim segment to the other end segment of said cross arm seal platform to produce bending moments between said first and second clamp means to elastically elongate the inner edges of each of the rim segment platforms while elastically compressing the outside edge of each of the rim segment platforms thereby to compensate for twisting or coning of each of the rim segment platforms between the hot inner edge and the cooler outer edge thereof because of thermal gradients produced thereacross so as to tend to maintain the seal face in a flat sealed relationship with the rotating matrix disc, a support platform, and means for locating said joined rim segments and cross arm for free radial expansion with respect to said support platform for the joined rim segments and cross arm at the connection points therebetween so as to accommodate thermally induced expansion of the regenerator seal assembly with respect to the support platform at elevated temperature conditions of operation.

* * * * *